US006775998B2

(12) United States Patent
Yuasa et al.

(10) Patent No.: US 6,775,998 B2
(45) Date of Patent: Aug. 17, 2004

(54) FREEZER AND REFRIGERATOR PROVIDED WITH FREEZER

(75) Inventors: Masashi Yuasa, Shiga (JP); Shuzo Kamimura, Shiga (JP); Hiroshi Yamada, Shiga (JP); Hideki Fukui, Shiga (JP); Yasuki Hamano, Osaka (JP); Naoki Yokoyama, Tottori (JP)

(73) Assignee: Matsushita Refrigeration Company, Shiga (JP)

( * ) Notice: Subject to any disclaimer, the term of this patent is extended or adjusted under 35 U.S.C. 154(b) by 0 days.

(21) Appl. No.: 10/416,329

(22) PCT Filed: Mar. 2, 2001

(86) PCT No.: PCT/JP01/01645

§ 371 (c)(1),
(2), (4) Date: Oct. 17, 2003

(87) PCT Pub. No.: WO02/39036

PCT Pub. Date: May 16, 2002

(65) Prior Publication Data

US 2004/0050083 A1 Mar. 18, 2004

(30) Foreign Application Priority Data

Nov. 10, 2000 (JP) ..... 2000-343294

(51) Int. Cl.[7] ..... F25B 39/02
(52) U.S. Cl. ..... 62/197
(58) Field of Search ..... 62/197, 198

(56) References Cited

U.S. PATENT DOCUMENTS 3,003,332 A * 10/1961 Watkins ..... 62/197
4,741,178 A * 5/1988 Fujiu et al. ..... 62/525
5,406,805 A * 4/1995 Radermacher et al. ..... 62/81
5,477,915 A * 12/1995 Park ..... 165/206
6,351,959 B1 * 3/2002 Hirota ..... 62/198

FOREIGN PATENT DOCUMENTS

| | | |
|---|---|---|
| JP | 38-22947 | 10/1963 |
| JP | 58-165557 | 11/1983 |
| JP | 58-219366 | 12/1983 |
| JP | 8-210753 | 8/1996 |
| JP | 11-257822 | 9/1999 |
| WO | 96/15413 | 5/1996 |

* cited by examiner

*Primary Examiner*—William E. Tapolcai
(74) *Attorney, Agent, or Firm*—Wenderoth, Lind & Ponack, L.L.P.

(57) ABSTRACT

Respective evaporators are set to a proper value in evaporation temperature and the efficiency in refrigeration cycle is enhanced, resulting in a reduction of energy consumption. A refrigerating unit and a refrigerator comprise a compressor, a condenser, a plurality of evaporators connected in series, a refrigerant flow rate adjustable unit and a refrigerant, thereby constituting a refrigeration cycle. The refrigerant flow rate adjustable unit controls each respective evaporation temperature of the plurality of evaporators. Preferably, the refrigeration unit further comprises a bypass circuit bypassing at least one of the plurality of evaporators and, when needs arise, the refrigerant is channeled through the bypass circuit. The refrigerant flow rate adjustable unit controls a flow rate of the refrigerant such that an evaporation temperature of the respective evaporators located at the upstream side of the refrigeration cycle is made higher than an evaporation temperature of the respective evaporators located at the downstream side thereof.

17 Claims, 11 Drawing Sheets

FREEZER AND REFRIGERATOR PROVIDED WITH FREEZER

TECHNICAL FIELD

The present invention relates to a refrigerating unit and a refrigerator equipped with the refrigerating unit.

BACKGROUND ART

In recent years, a refrigerating unit to provide cooling for a plurality of compartments, each provided with an evaporator, and a refrigerator equipped with the refrigerating unit have been disclosed.

A prior art refrigerating unit of this kind is disclosed in the Japanese Patent Application Unexamined Publication No. S58-219366 of 1984.

Next, a description is given to the aforementioned prior art refrigerating unit with reference to drawings.

FIG. 9 is a block diagram of a cooling system of the prior art refrigerating unit. In FIG. 9, a refrigerant compressed in a compressor 1 is condensed by dissipating heats in condenser 2 and then fed to refrigerant branching unit 3.

The branched refrigerant is partially returned to compressor 1 after going through first solenoid valve 4, first capillary tube 5 and first evaporator 6, thereby forming a first refrigerant circuit. In parallel to the foregoing first refrigerant circuit is formed a second refrigerant circuit starting from refrigerant branching unit 3, passing second solenoid 7, second capillary tube 8 and second evaporator 9, and returning to compressor 1.

First evaporator 6 is installed in first cooling compartment 11 of refrigerator's main body 10 and second evaporator 9 is installed in second cooling compartment 12. First controlling means 13 detects the temperatures in first cooling compartment 11 and controls closing/opening of first solenoid 4. Second controlling means 14 detects the temperatures in second cooling compartment 12 and controls closing/opening of second solenoid 7.

Next, a description is given to how the refrigerating unit structured as above operates.

A refrigerant is compressed by compressor 1 and condensed by dissipating heat in condenser 2. After passing refrigerant branching unit 3, the refrigerant is depressurized in first capillary tube 5 and evaporated in first evaporator 6 when first solenoid 4 is open, thereby providing cooling for first cooling compartment 11. First controlling means 13 controls closing/opening of first solenoid 4, thereby controlling first cooling compartment 11 to a predetermined temperature.

Similarly, the refrigerant branched at refrigerant branching unit 3 is depressurized in second capillary tube 8 and evaporated in second evaporator 9 when second solenoid 7 is open, thereby providing cooling for second cooling compartment 12. Second controlling means 14 controls closing/opening of second solenoid 7, thereby controlling second cooling compartment 12 to a predetermined temperature. When the respective cooling compartments are not allowed to be controlled only by closing/opening of the respective solenoids, the respective cooling compartments are controlled by operating and stopping of compressor 1.

A prior art refrigerator is disclosed in the Japanese Patent Application Unexamined Publication No. H8-210753 of 1996.

A description is given to the aforementioned prior art refrigerator with reference to drawings.

FIG. 10 is a longitudinal cross-sectional view for showing an outline structure of the prior art refrigerator. FIG. 11 is a block diagram of a cooling system of the prior art refrigerator. FIG. 12 is a block diagram for showing an operation control circuit of the prior art refrigerator.

In FIG. 10, refrigerator's main body 15 has freezer compartment 16 and cold storage compartment 17 that are separated from each other to prevent chilled air from mixing therebetween. First evaporator 18 is installed in freezer compartment 16 and second evaporator 19 is installed in cold storage compartment 17. First air blower 20 is disposed right next to first evaporator 18 and second air blower 21 is disposed right next to second evaporator 19. Compressor 22 is installed in the lower back part of refrigerator's main body 15.

In FIG. 11, compressor 22, condenser 23, capillary tube 24 acting as a pressure reducer, first evaporator 18, refrigerant tube 25 and second evaporator 19 are connected in succession, thereby establishing a closed circuit. Refrigerant tube 25 connects between first evaporator 18 and second evaporator 19.

Subsequently, as FIG. 12 shows, freezer compartment temperature adjusting unit 27 to set up the temperatures of freezer compartment 16, cold storage compartment temperature adjusting unit 28 to set the temperatures of cold storage compartment 17, freezer compartment temperature detecting means 29 to detect the temperatures of freezer compartment 16 and cold storage compartment temperature detecting means 30 to detect the temperatures of cold storage compartment 17 are connected to the input terminal of controlling means 26 acting as a controller. First relay 31 and second relay 32 are connected to the output terminal of controlling means 26.

First switch 34, which is turned on/off according to the behavior of first relay 31, is connected to one of the terminals of power supply 33. Compressor 22 and second switch 35 are connected to the output terminal of first switch 34. Aforementioned first air blower 20 is connected to contact a of second switch 35. Aforementioned second air blower 21 is connected to contact b of second switch 35.

Next, a description is given to how the refrigerator structured as above operates.

A refrigerant is compressed by compressor 22 and condensed by dissipating heat in condenser 23. The condensed refrigerant is reduced in pressure in capillary tube 24 and part of the refrigerant is evaporated in first evaporator 18 and the balance of the refrigerant is evaporated while passing through second evaporator 19. Thus, a heat exchange reaction takes place in the respective evaporators. Then, the refrigerant in a gaseous state is sucked into compressor 22. Such a refrigeration cycle as above is repeated as compressor 22 is brought into operation.

By the action of a mechanical draft of first air blower 20 and second air blower 21, the air in freezer compartment 16 and cold storage compartment 17 undergoes a heat exchange in first evaporator 18 and second evaporator 19.

At this time, when the temperature detected by freezer compartment temperature detecting means 29 is higher than the temperature set up by freezer compartment temperature adjusting unit 27, controlling means 26 brings first relay 31 into operation to turn on first switch 34, thereby bringing compressor 22 into operation. Further, when the temperature detected by cold storage compartment temperature detecting means 30 is higher than the temperature set up by cold storage compartment temperature adjuster 28, controlling means 26 connects second relay 32 to contact b of second switch 35, thereby bringing second air blower 21 into operation. As a result, cold storage compartment 17 undergoes cooling selectively and is controlled to a predetermined temperature.

On the other hand, when the temperature detected by freezer compartment detecting means 29 is higher than the temperature set up by freezer compartment temperature adjusting unit 27 and the temperature detected by cold storage compartment temperature detecting means 30 is lower than the temperature set up by cold storage compartment temperature adjusting unit 28, controlling means 26 connects second relay 32 to contact a of second switch 35, thereby bringing first air blower 20 into operation. As a result, freezer compartment 16 undergoes cooling selectively and is controlled to a predetermined temperature.

When the temperature detected by freezer compartment temperature detecting means 29 is lower than the temperature set up by freezer compartment temperature adjusting unit 27, controlling means 26 brings first relay 31 into operation to turn off first switch 34, thereby bringing compressor 22 to a halt.

However, the structure of the prior art refrigerating unit is such that cooling control of each respective cooling compartment is exercised by on/off of respective solenoids or operation/halt of respective compressors, thereby bringing about big fluctuations in temperature of respective evaporators and also cooling compartments. As a result, there exists a drawback of the inability to maintain good quality of what is stored for a long period.

Since a capillary tube is used as a pressure reducing means for each respective evaporator, the evaporation temperature of each respective evaporator is determined by the entrance pressure of the evaporator. Therefore, the evaporator's evaporation temperature is not variable and uncontrollable. As result, the efficiency of a refrigerating unit is not enhanced sufficiently and there exists a drawback of not allowing the electric power consumption to be reduced enough.

The present invention is to provide a high efficiency refrigerating unit by allowing the temperature variation of an object to be cooled caused by an evaporator to be minimized.

In the structure of the prior art refrigerator as described in above, first evaporator 18 and second evaporator 19 linked by refrigerant tube 25 and, therefore, the evaporation temperatures of respective evaporators are almost the same. In addition, since cooling control of freezer compartment 16 and cold storage compartment 17 is exercised by operation control of first air blower 20 and second air blower 21, electric power is consumed wastefully, in particular, due to a decline in cooling efficiency caused by cooling at an unnecessarily low temperature that takes place in cold storage compartment 17 where great temperature differentials exist in comparison with the evaporation temperature. Further, a compartment temperature variation and a humidity decline occur, thereby bringing about such a drawback as degrading the quality of foods in storage due to temperature stresses imposed on the foods or accelerated drying of the foods.

The present invention provides a refrigerator exhibiting a high cooling efficiency and achieving high storage quality of foods by bringing the evaporation temperature of each respective evaporator closer to the temperature set up for each respective cooling compartment.

SUMMARY OF THE INVENTION

A refrigerating unit of the present invention comprises:

(a) a compressor;

(b) a condenser;

(c) a plurality of evaporators connected in series;

(d) a capillary tube disposed between the condenser and each of the plurality of evaporators;

(e) a refrigerant flow rate adjustable unit disposed between respective evaporators of the plurality of evaporators; and (f) a refrigerant, in which the compressor, condenser, evaporator, capillary tube, refrigerant flow rate adjustable unit and refrigerant constitute a refrigeration cycle, the refrigerant is circulated in the refrigeration cycle, and the refrigerant flow rate adjustable unit controls respective evaporation temperatures of the plurality of evaporators.

The refrigerant flow rate adjustable unit is preferred to control a flow of the refrigerant in such a way as the evaporation temperature of each respective evaporator located at the upstream side of the refrigeration cycle is made higher than the evaporation temperature of each respective evaporator located at the downstream side of the refrigeration cycle.

Preferably, the refrigerating unit further comprises:

(f) a bypass circuit to bypass at least one evaporator of the plurality of evaporators, in which the bypass circuit is disposed in parallel with the at least one evaporator, the compressor, condenser, evaporator, capillary tube, refrigerant flow rate adjustable unit, bypass circuit and refrigerant constitute a refrigeration cycle, the refrigerant is circulated in the refrigeration cycle, and the refrigerant flow rate adjustable unit controls respective evaporation temperatures of the plurality of evaporators variably.

A refrigerator of the present invention comprises a plurality of cooling compartments and the refrigerating unit as described in above.

It is also preferred that each respective cooling compartment of the plurality of cooling compartments has a set up temperature that is different from one another, the evaporators are disposed in a cooling compartment of the plurality of cooling compartments, respectively, and the respective evaporators located at the upstream side of the refrigeration cycle are, in succession, disposed in a cooling compartment having a higher set up temperature.

Accordingly, each respective evaporator has a proper evaporation temperature. Therefore, the refrigeration cycle efficiency is enhanced, resulting in a reduction of the amount of energy consumed. In addition to achieving the foregoing advantage, a refrigerator having enhanced storage quality for the foods stored is made available.

DETAILED DESCRIPTION OF PREFERRED EMBODIMENTS

Figure 1:
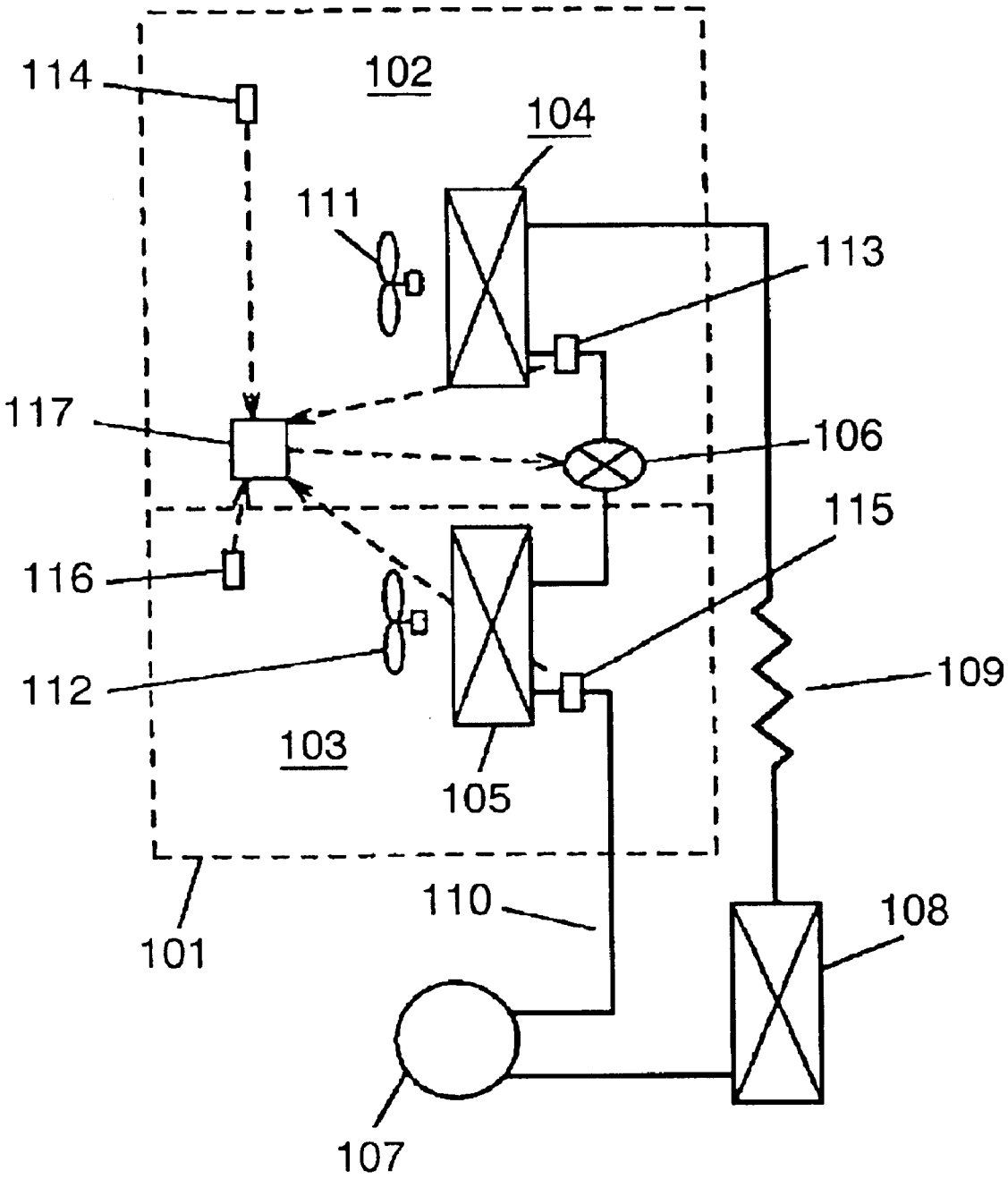
FIG. 1 is a refrigeration system diagram of a refrigerating unit in exemplary embodiment 1 of the present invention.

A refrigerating unit in an exemplary embodiment of the present invention comprises a compressor, a condenser, a plurality of evaporators connected in series, a capillary tube disposed between the condenser and the evaporator and a refrigerant flow rate adjustable unit disposed between evaporators of the plurality of evaporators, and the compressor, condenser, plurality of evaporators, capillary tube and the refrigerant flow rate adjustable unit constitute a refrigeration cycle, and also refrigerant flow rate adjustable unit controls the rate of refrigerant flow, thereby having respective evaporation temperatures of the plurality of evaporators set to a higher value in succession starting from the upstream side of the refrigeration cycle. Accordingly, by combining the capillary tube and the throttling action of the refrigerant flow rate adjustable unit, the respective evaporation temperatures of the plurality of evaporators are ratcheted down in succession, resulting in a differentiation of the evaporation temperatures. In addition, each respective evaporator is set to a proper evaporation temperature, thereby enhancing the efficiency of refrigeration cycle.

A refrigerating unit in another exemplary embodiment of the present invention comprises a compressor, a condenser, a plurality of evaporators connected in series, a capillary tube disposed between the condenser and the evaporator, a refrigerant flow rate adjustable unit disposed between evaporators of the plurality of evaporators and a bypass circuit bypassing at least one evaporator of the plurality of evaporators, and the compressor, condenser, plurality of evaporators, refrigerant flow rate adjustable unit, capillary tube and bypass circuit constitute a refrigeration cycle, and also the refrigerant flow rate adjustable unit controls the evaporation temperatures of the plurality of evaporators variably. Accordingly, a desired evaporation temperature for each respective evaporator is adjusted arbitrarily. As a result, a cooling function exhibiting proper and high efficiency comes into play. Furthermore, when cooling of an evaporator of interest is not needed, that particular evaporator is bypassed, thereby allowing only the evaporators requiring cooling to be cooled down in a concentrated manner. Therefore, wasteful cooling can be avoided.

A refrigerating unit in still another exemplary embodiment of the present invention comprises a compressor, a condenser, a first evaporator and a second evaporator connected in series, a refrigerant flow rate adjustable unit disposed between the first evaporator and the second evaporator, a capillary tube disposed between the condenser and the first evaporator, and a bypass circuit to bypass the first evaporator and the refrigerant flow rate adjustable unit, and the compressor, condenser, first evaporator, second evaporator, refrigerant flow rate adjustable unit, capillary tube and bypass circuit constitute a refrigeration cycle, and also the flow rate of refrigerant is controlled by the refrigerant flow rate adjustable unit, thereby allowing the evaporation temperature of the first evaporator to be set to a temperature higher than the evaporation temperature of the second evaporator.

Accordingly, each respective evaporation temperature of the first evaporator and the second evaporator is adjusted arbitrarily to realize a differentiation of the evaporation temperatures. When cooling of the first evaporator is not needed, the first evaporator is bypassed, thereby allowing the refrigerant to flow in the second evaporator in a concentrated manner and eliminating the energy waste by performing cooling in the necessary evaporators only. In addition, the temperature fluctuations due to excessive cooling of the object to be cooled by the first evaporator are suppressed.

It is preferred that the refrigerant flow rate adjustable unit has a totally closing function and the totally closing function is put into operation when the evaporator disposed in parallel with the bypass circuit is not required to be cooled. Accordingly, a highly accurate flow rate control is carried out less costly and also reliable refrigerant flow channel switching is made possible.

Preferably, the aforementioned totally closing function is performed when the evaporator disposed in parallel with the bypass circuit is defrosted under an off cycle state, thereby allowing the defrosting to take place without wasting electric power in defrosting heaters and the like.

A refrigerator in an exemplary embodiment of the present invention comprises the refrigerating unit as described in above, a plurality of cooling compartments for keeping foods cold and in storage and a refrigerating unit, and each evaporator of a plurality of evaporators is disposed in the cooling compartment, respectively, each being set to a higher temperature in succession starting from the upstream side of a refrigeration cycle. Accordingly, the respective evaporation temperatures of the plurality of evaporators are controlled variably. In addition, by setting properly the evaporation temperature of each respective evaporator, the changes in temperature and dryness are suppressed such that the difference between the storage temperature of the foods stored and the cold air temperature is reduced.

A refrigerator in another exemplary embodiment of the present invention comprises the refrigerating unit as described in above, a cold storage temperature compartment, a freezer temperature compartment and a refrigerating unit, and a first evaporator is disposed in the cold storage temperature compartment and a second evaporator is disposed in the freezer temperature compartment. Accordingly, the temperature difference between the first evaporator and the second evaporator is maintained sufficiently large. As a result, the temperature difference required of the cold storage compartment and the freezer compartment is realized efficiently. In addition, the difference between the cold storage compartment temperature that is above zero ° C. and the evaporation temperature of the first evaporator is reduced, thereby allowing the temperature changes and dehumidifying action of the cold storage compartment to be suppressed.

Preferably, the extent of throttling of a refrigerant flow rate adjustable unit is controlled such that the temperature difference between the evaporation temperature of respective evaporators and the compartment temperature is not exceeding 5° C., thereby further suppressing the temperature changes and dryness in the cooling compartment and also enhancing the efficiency of refrigeration cycle.

Preferably, the evaporation temperature of the first evaporator is controlled to range from −5° C. to 5° C., thereby bringing about a further reduction in the difference between the cold storage compartment and the evaporation temperature of the first evaporator. As a result, the temperature changes and dehumidifying action of the cold storage compartment are further suppressed.

Preferably, the refrigerant flow rate adjustable unit is installed in the freezer temperature compartment, thereby reducing the frosting on an electric expansion valve. As a result, the defrosting operation is facilitated.

Preferably, when the freezer temperature compartment is rapidly cooled down, the extent of throttling of the refrigerant flow rate adjustable unit is increased and the evaporation temperature of the second evaporator is lowered. Accordingly, the temperature of the cold air fed to the freezer compartment is lowered, thereby accelerating the refrigeration speed of foods and the like and enhancing the effect of rapid refrigeration.

Next, a description is given to a refrigerating unit and a refrigerator equipped with the refrigerating unit in exemplary embodiments of the present invention with reference to drawings.

Exemplary Embodiment 1

Figure 2:
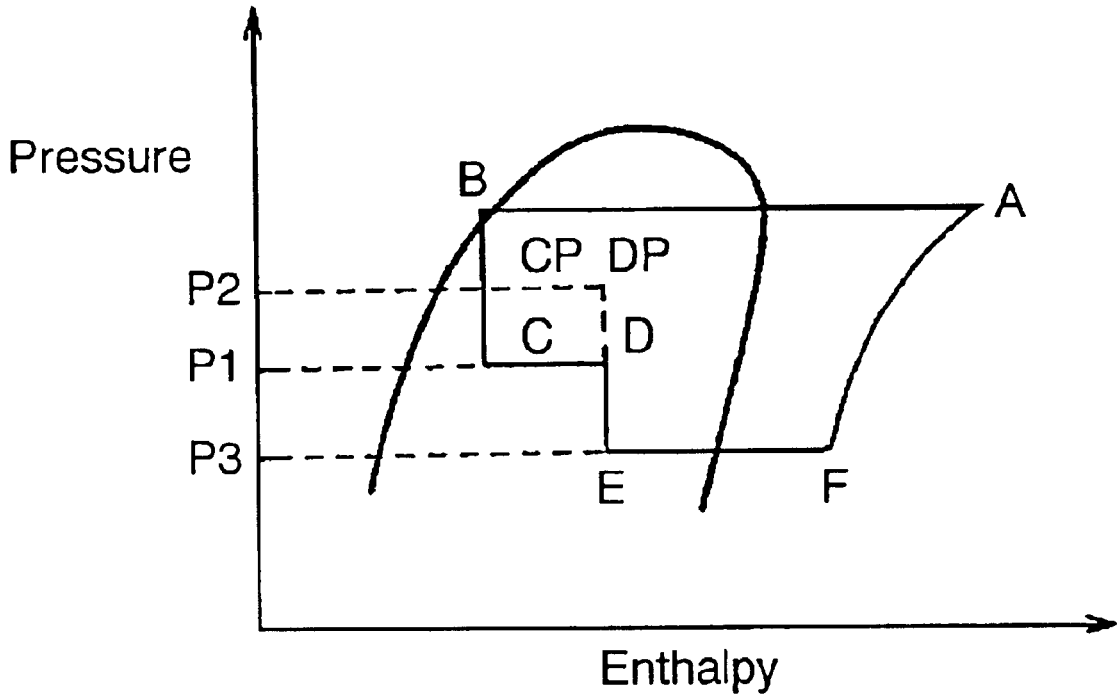
FIG. 2 is a Mollier chart of the refrigerating unit in exemplary embodiment 1 of the present invention.

FIG. 1 is a refrigeration system diagram of a refrigerator equipped with a refrigerating unit in exemplary embodiment 1 of the present invention. FIG. 2 is a Mollier chart of a refrigeration cycle of the refrigerator equipped with the refrigerating unit of the present exemplary embodiment.

In FIG. 1, refrigerator's main body 101 comprises cold storage compartment 102 and freezer compartment 103, first evaporator 104 is disposed in cold storage compartment 102 and second evaporator 105 is disposed in freezer compartment 103. Refrigerant flow rate adjustable unit 106 comprising an electric expansion valve and the like is disposed between first evaporator 104 and second evaporator 105.

Compressor 107, condenser 108, capillary tube 109, first evaporator 104, compressor 107, suction pipe 110 and second evaporator 105 constitute a ring-shaped refrigeration cycle. Suction pipe 110 connects between second evaporator 105 and compressor 107. First evaporator 104 and second evaporator 105 are connected in series.

First air blower 111 causes a forced heat exchange to take place in the air between first evaporator 104 and cold storage compartment 102. Second air blower 112 causes a forced heat exchange to take place in the air between second evaporator 105 and freezer compartment 103. First evaporator temperature detecting means 113 is disposed near the outlet of first evaporator 104. Cold storage compartment temperature detecting means 114 detects the temperatures in cold storage compartment 102. Second evaporator temperature detecting means 115 is disposed near the outlet of second evaporator 105. Freezer compartment temperature detecting means 116 detects the temperatures in freezer compartment 103.

According to the information from first evaporator temperature detecting means 113, cold storage compartment temperature detecting means 114, second evaporator temperature detecting means 115 and freezer compartment temperature detecting means 116, controlling means 117 controls the opening of refrigerant flow rate adjustable unit 106.

According to the setup as described in above, a refrigerant is compressed by compressor 107 and the compressed refrigerant dissipates heat and is condensed in condenser 108, and then enters in capillary tube 109. The refrigerant condensed and reduced in pressure enters in first evaporator 104 and evaporates at the saturation temperature under a pressure corresponding to the extent of throttling (opening) of refrigerant flow rate adjustable unit 106.

When the opening of refrigerant flow rate adjustable unit 106 is large, the refrigerant pressure becomes close to the suction pressure (low pressure) of compressor 107, resulting in a low evaporation temperature on the part of first evaporator 104. Conversely, when the opening of refrigerant flow rate adjustable unit 106 is small, the pressure in first evaporator 104 becomes high, resulting in a high evaporation temperature. The evaporation temperatures of first evaporator 104 are controlled by adjusting the opening of refrigerant flow rate adjustable unit 106 via controlling means 117. Controlling means 117 goes into action based on the information from first evaporator temperature detecting means 113 and cold storage compartment temperature detecting means 114. Then, the refrigerant reduced in pressure by refrigerant flow rate adjustable unit 106 evaporates in second evaporator 105 and returns to compressor 107 via suction pipe 110.

A description is given to the above operation with reference to the Mollier chart of FIG. 2. The refrigerant is changed in state from point A to point B by condenser 108 and reduced in pressure from point B to point C by capillary tube 109 and then enters in first evaporator 104 at point C on the Mollier chart. The refrigerant that enters in first evaporator 104 evaporates at the saturation temperature under pressure P1. Point D indicates the inlet to refrigerant flow rate adjustable unit 106 and the refrigerant is reduced in pressure to point E corresponding to the outlet of refrigerant flow rate adjustable unit 106 in position, enters in second evaporator 105 and evaporates at the saturation temperature under pressure P3. Then, the refrigerant is sucked in compressor 107 at point F and compressed to point A. When the opening of refrigerant flow rate adjustable unit 106 is narrowed down at this point, point C is shifted to point Cp and point D to point Dp, thereby increasing the refrigerant pressure to P2 and moving upward the evaporation temperature of first evaporator 104. Conversely, when the opening of refrigerant flow rate adjustable unit 106 is expanded, the pressure of point C is declined and the evaporation temperature of first evaporator 104 is also lowered.

Therefore, when cold storage compartment 102 is kept at a cold storage temperature (0° C. to 5° C., for example,) by first evaporator 104 and first air blower 111, the opening of refrigerant flow rate adjustable unit 106 is controlled such that the difference in temperature between the inside of cold storage compartment 102 and first evaporator 104 is kept small (around 5° C., for example). As a result, the temperature changes in cold storage compartment 102 become small.

When the difference in temperature between the inside of cold storage compartment 102 and first evaporator 104 is small, the dehumidifying action in cold storage compartment 102 is allowed to be suppressed, thereby keeping the humidity in cold storage compartment 102 high and preventing the foods stored therein from becoming dry.

By controlling the opening of refrigerant flow rate adjustable unit 106 periodically (once an hour or so, for example) such that the evaporation temperature of first evaporator 104 is kept at around 5° C. to 10° C., first evaporator 104 is allowed to be defrosted without needing a special heating unit, thereby preventing the increase in temperature of cold storage compartment 102. As a result, savings in production costs involved with the heating unit are achieved.

In addition, since the difference between the temperature of cold storage compartment 102 and the evaporation temperature of first evaporator 104 becomes small, thereby allowing the evaporation temperature to be set somewhat high, the efficiency of refrigeration cycle is enhanced and greater energy savings are made possible.

When the load imposed on cold storage compartment 102 is heavy or during the initial period of installing a refrigerator for use, the amount of refrigerant in circulation is increased by controlling the opening of refrigerant flow rate adjustable unit 106, thereby allowing the period of time needed for cooling down to a predetermined temperature to be shortened.

Further, by controlling the opening of refrigerant flow rate adjustable unit 106, it becomes possible for cold storage compartment 102 to have the capabilities of acting as a temperature selector whereby any temperatures ranging from a cold storage compartment temperature to a freezer compartment temperature are freely selected. Thus, a refrigerator having the great convenience to customers and satisfying the customers' requirements is made available.

On the other hand, freezer compartment 103 is kept at a predetermined temperature (a freezer compartment temperature of −20° C., for example) by second evaporator 105 and second air blower 112. And, when the load imposed on freezer compartment 103 becomes heavy, the opening of refrigerant flow rate adjustable unit 106 is controlled according to the information from first evaporator temperature detecting means 113, cold storage compartment temperature detecting means 114, second evaporator temperature detecting means 115 and freezer compartment temperature detecting means 116, thereby increasing the amount of refrigerant in circulation of freezer compartment 103. As a result, the temperature of freezer compartment 103 is adjusted to a predetermined temperature in a short period of time. Conversely, when the load imposed on cold storage compartment 102 and freezer compartment 103 is light, the opening of refrigerant flow rate adjustable unit 106 is controlled such that the amount of refrigerant in circulation is reduced, thereby enhancing the system efficiency and achieving energy savings.

Controlling means 117 evaluates the information from first evaporator temperature detecting means 113 and cold storage temperature detecting means 114. As a result of the evaluation, the opening of refrigerant flow rate adjustable unit 106 is controlled such that the evaporation temperature of first evaporator 104 for cold storage compartment 102 is adjusted to range from −5° C. to 5° C. Furthermore, the efficiency of refrigeration cycle is enhanced and the difference between the evaporation temperature of first evaporator 104 and the temperature of cold storage compartment 102 is further reduced, thereby enabling the temperature changes of cold storage compartment 102 to be further reduced. A higher evaporation temperature of first evaporator 104 allows the dehumidifying action against cold storage compartment 102 to be suppressed, thereby enhancing the storage quality further by keeping cold storage compartment 102 at a high humidity and preventing the foods stored from becoming dry.

Furthermore, when freezer compartment 103 is required to have the foods frozen rapidly for the purpose of home freezing of foods, controlling means 117 evaluates the information from first evaporator temperature detecting means 113, cold storage temperature detecting means 114, second evaporator temperature detecting means 115 and freezer compartment temperature detecting means 116. As a result of the evaluation, the opening of refrigerant flow rate adjustable unit 106 is reduced in extent such that the evaporation temperature of second evaporator 105 is lowered, thereby making the cold air supplied to freezer compartment 103 by second air blower 112 lower in temperature and enabling the foods stored to be frozen rapidly.

Although first evaporator 104 is disposed in cold storage compartment 102 in the present exemplary embodiment, the location of first evaporator 104 is not restricted to above and can be anywhere in the vicinity of the cold storage temperature zone. And, first evaporator 104 is disposed near the temperature zone requiring the control of temperatures apart from the freezer compartment temperature zone and comprising the temperatures of a vegetable compartment at a cold storage temperature, a low temperature compartment belonging to the range of low temperature storage (encompassing such compartments with a temperature zone of around −5° C. to 0° C. as a partial freezing compartment, ice cold compartment, chilled foods compartment, etc.) and the like.

Exemplary Embodiment 2

Figure 3:
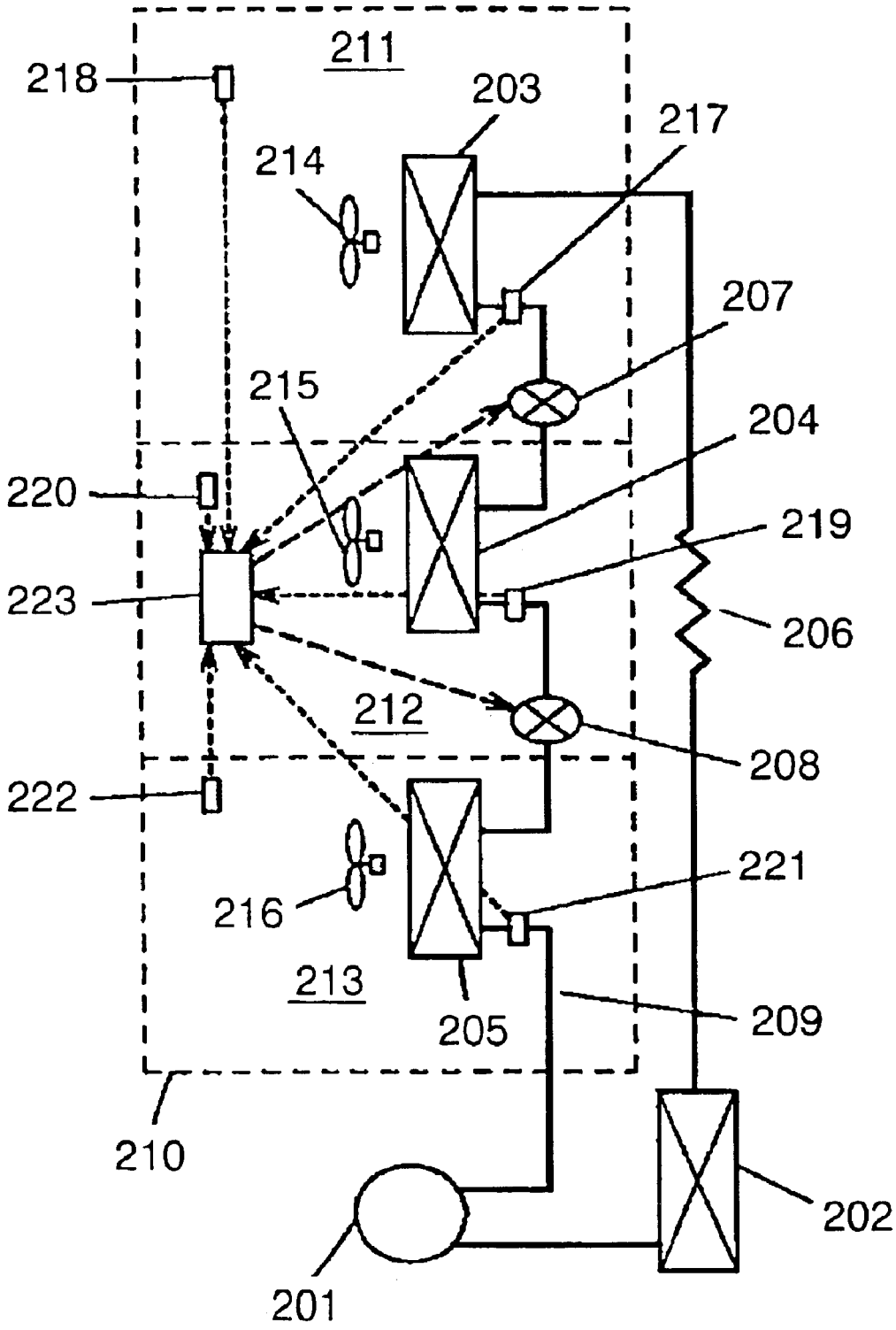
FIG. 3 is a refrigeration system diagram of a refrigerating unit in exemplary embodiment 2 of the present invention.
Figure 4:
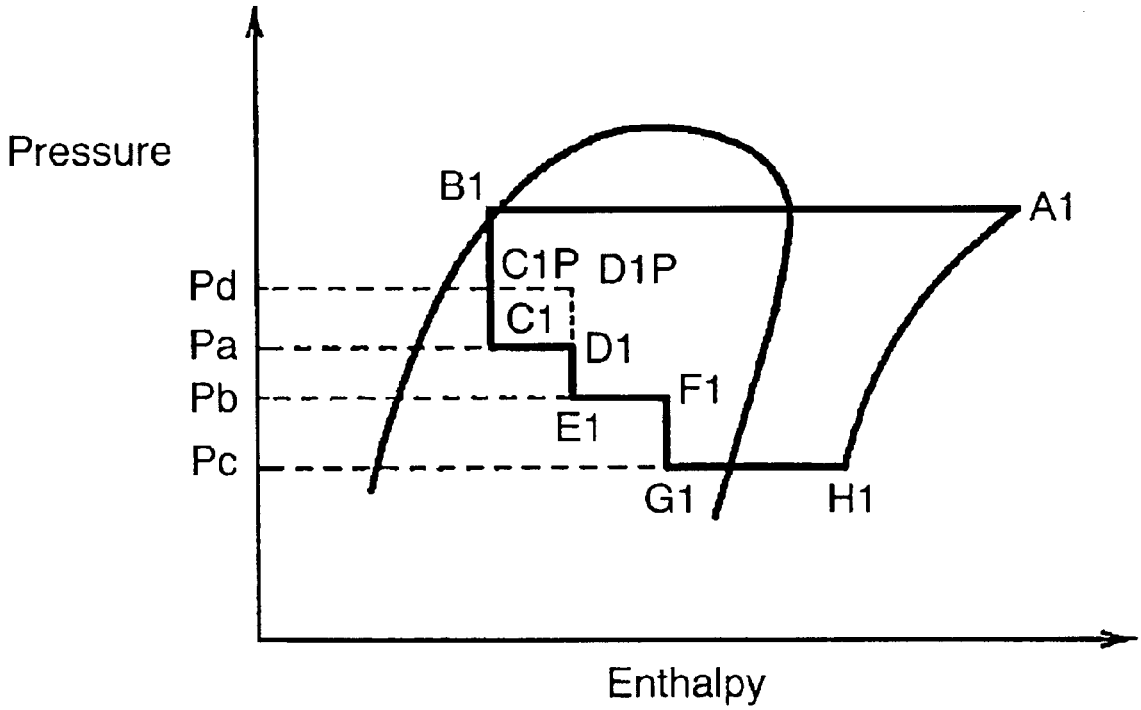
FIG. 4 is a Mollier chart of the refrigerating unit in exemplary embodiment 2 of the present invention.

FIG. 3 is a refrigeration system diagram of a refrigerator equipped with a refrigerating unit in exemplary embodiment 2 of the present invention. FIG. 4 is a Mollier chart of a refrigeration cycle of the refrigerator equipped with a refrigerating unit of the present exemplary embodiment.

In FIG. 3, compressor 201, condenser 202, first evaporator 203, second evaporator 204 and third evaporator 205 are connected in series. Capillary tube 206 is connected between the outlet of condenser 202 and the inlet of first evaporator 203. Refrigerant flow rate adjustable unit 207 is disposed between first evaporator 203 and second evaporator 204. Refrigerant flow rate adjustable unit 208 is disposed between second evaporator 204 and third evaporator 205. As refrigerant flow rate adjustable units 207 and 208 are used an electric expansion valve and the like, for example. Suction pipe 209 connects between the out let of third evaporator 205 and compressor 201. Thus, a ring-shaped refrigeration cycle is formed.

First evaporator 203 is disposed in first cooling compartment 211 where temperatures are set to the highest value in refrigerator's main body 210. Second evaporator 204 is disposed in second cooling compartment 212 where temperatures are set to the second-highest value in refrigerator's main body 210. Third evaporator 205 is disposed in third cooling compartment 213 where temperatures are set to the lowest value.

First air blower 214 is installed in first cooling compartment 211. Second air blower 215 is installed in second cooling compartment 212. Third air blower 216 is installed in third cooling compartment 213. First evaporator temperature detecting means 217 is located near the outlet of first evaporator 203. First cooling compartment temperature detecting means 218 detects the temperatures in first cooling compartment 211. Second evaporator temperature detecting means 219 is located near the outlet of second evaporator 203. Second cooling compartment temperature detecting means 220 detects the temperatures in second cooling compartment 212. Third evaporator temperature detecting means 221 is located near the outlet of third evaporator 205. Third cooling compartment temperature detecting means 222 detects the temperatures in third cooling compartment 213.

Based on the information from first evaporator temperature detecting means 217, first cooling compartment temperature detecting means 218, second evaporator temperature detecting means 219, second cooling compartment temperature detecting means 220, third evaporator temperature detecting means 221 and third cooling compartment temperature detecting means 222, controlling means 223 adjusts the opening of refrigerant flow rate adjustable units 207 and 208, respectively.

Next, a description is given to how the refrigeration cycle constituted as above behaves.

The refrigerant compressed in compressor 201 dissipates heat and is condensed in condenser 202, and then enters in capillary tube 206. The de-pressurized liquid refrigerant enters in first evaporator 203 and second evaporator 204 and then part of the liquid refrigerant evaporates at the saturation temperature under a pressure corresponding to the extent of throttling (opening) of refrigerant flow rate adjustable units 207 and 208, respectively. When the opening of refrigerant flow rate adjustable unit 207 is increased, the evaporation temperature of first evaporator 203 is lowered since the evaporation pressure of first evaporator 203 becomes closer to that of second evaporator 204. Conversely, when the opening of refrigerant flow rate adjustable unit 20 is reduced, the pressure in first evaporator 203 is increased, thereby leading to a higher evaporation temperature.

Controlling of the evaporation temperatures of first evaporator 203 and second evaporator 204 is performed by adjusting the opening of refrigerant flow rate adjustable units 207 and 208 via controlling means 223, respectively. The information of evaporation temperature controlling is furnished by first evaporator temperature detecting means 217, first cooling compartment temperature detecting means 218, second evaporator temperature detecting means 219, second cooling compartment temperature detecting means 220, third evaporator temperature detecting means 221 and third cooling compartment temperature detecting means 222.

And, the refrigerant that remains after depressurization performed further in refrigerant flow rate adjustable units 207 and 208 evaporates in third evaporator 205 at the evaporation temperature corresponding to a suction pressure (low pressure) of compressor 201 and returns to compressor 201 via suction pipe 209.

A description is given to the above operation with reference to the Mollier chart of FIG. 4. The refrigerant is changed in state from point A1 to point B1 by condenser 202 and reduced in pressure from point B1 to point C1 by capillary tube 206. The refrigerant that enters in first evaporator 203 at point C1 on the Mollier chart evaporates at the saturation temperature under pressure Pa. Point D1 indicates the inlet to refrigerant flow rate adjustable unit 207, and the refrigerant is reduced in pressure to point E1 corresponding to the outlet of refrigerant flow rate adjustable unit 207 in position, enters in second evaporator 204 and evaporates at the saturation temperature under pressure Pb. Point F1 is the inlet of refrigerant flow rate adjustable unit 208, and the refrigerant is reduced in pressure to point G1 corresponding to the outlet of refrigerant flow rate adjustable unit 208 in position, enters in third evaporator 205 and evaporates at the saturation temperature under pressure Pc. Then, the refrigerant is sucked in compressor 201 at point H1 and compressed to point A1.

When the opening of refrigerant flow rate adjustable unit 207 is narrowed down at this point, point C1 is shifted to point C1*p* and point D1 to point D1*p*, thereby increasing the pressure of the refrigerant to Pd and moving upward the evaporation temperature of first evaporator 203. Conversely, when the opening of refrigerant flow rate adjustable unit 207 is expanded, the pressure of point C1 is declined and the evaporation temperature of first evaporator 203 is lowered.

Therefore, when the temperature of first cooling compartment 211 having the highest value as the set up temperature is kept at a cold storage temperature (0° C. to 5° C., for example), the opening of refrigerant flow rate adjustable unit 207 is adjusted to increase the evaporation temperature of first evaporator 203, resulting in a reduction of the difference in temperature between the cooling compartment and the evaporator. As a result, the temperature of cold air sent in by first air blower 215 is prevented from being lowered excessively, thereby reducing the temperature changes in the cooling compartment and suppressing the dehumidifying action. Therefore, the storage quality of foods stored in first cooling compartment 211 is enhanced. Also, the evaporation temperatures are increased appropriately and the efficiency of refrigeration cycle is enhance, resulting in achieving energy savings.

By controlling the opening of refrigerant flow rate adjustable units 207 and 208 periodically (once an hour or so, for example) such that the evaporation temperatures of first evaporator 203 and second evaporator 204 are kept at around 5° C. to 10° C., respectively, there is no need of a special heating unit to defrost the evaporators, thereby preventing the increase in temperature of the cooling compartment. As a result, savings in production costs involved with the heating unit are achieved.

When the load imposed on the cooling compartment is heavy or during the initial period of installing a refrigerator for use, the amount of refrigerant in circulation is increased by controlling the respective openings of refrigerant flow rate adjustable units 207 and 208, thereby allowing the period of time needed for adjusting to a predetermined temperature to be shortened.

Also, third cooling compartment 213 is kept at a predetermined temperature (a freezer temperature of −20° C., for example) by third evaporator 205 and third air blower 217. When the load imposed on the cooling compartment becomes heavy, the respective openings of refrigerant flow rate adjustable units 207 and 208 are adjusted based on the information from first evaporator temperature detecting means 217, first cooling compartment temperature detecting means 218, second evaporator temperature detecting means 219, second cooling compartment temperature detecting means 220, third evaporator temperature detecting means 221 and third cooling compartment temperature detecting means 222, thereby increasing the amount of refrigerant in circulation and allowing the temperature of the cooling compartment to be adjusted to a predetermined temperature in a short period of time. Conversely, when the load imposed on the cooling compartment is light, the respective openings of refrigerant flow rate adjustable units 207 and 208 are controlled such that the amount of refrigerant in circulation is reduced, thereby enhancing the system efficiency and achieving energy savings.

Further, by controlling the respective openings of refrigerant flow rate adjustable units 207 and 208, it becomes possible for the temperatures of first cooling compartment 211 and second cooling compartment 212 to be set to a temperature ranging from a cold storage temperature to a freezing temperature freely. Thus, a refrigerator having the great convenience to customers and satisfying the customers' requirements is made available.

The information from first evaporator temperature detecting means 217, first cooling compartment temperature detecting means 218, second evaporator temperature detecting means 219, second cooling compartment temperature detecting means 220, third evaporator temperature detecting means 221 and third cooling compartment temperature detecting means 222 is evaluated by controlling means 223. Based on the information, the respective openings of refrigerant flow rate adjustment units 207 and 208 are adjusted such that the difference between the evaporation temperature of an evaporator in each respective cooling compartment and the temperature inside of each respective cooling compartment does not exceed 5° C., thereby allowing the temperature changes and dehumidifying action in each respective cooling compartment to be suppressed. The proper evaporation temperatures and the proper amount of refrigerant in circulation allow further enhancement of system efficiency and savings of energy to be realized.

Although the present exemplary embodiment deals with a refrigerator comprising three cooling compartments and evaporators, the present invention is not restricted to above by any means and the following configurations are also possible. For example, each respective cooling compartment of the three cooling compartments is assigned with the function of serving as a cold storage compartment, a low temperature compartment or a freezer compartment by setting the evaporation temperature of each of the foregoing compartments to the intended temperature zone with a successive reduction of evaporation temperature. Thus, a cooling function separate from one another is provided to each respective cooling compartment. As a result, the optimum efficiency in refrigeration cycle is realized and also the most suitable storage quality for foods stored is achieved.

Exemplary Embodiment 3

Figure 5:
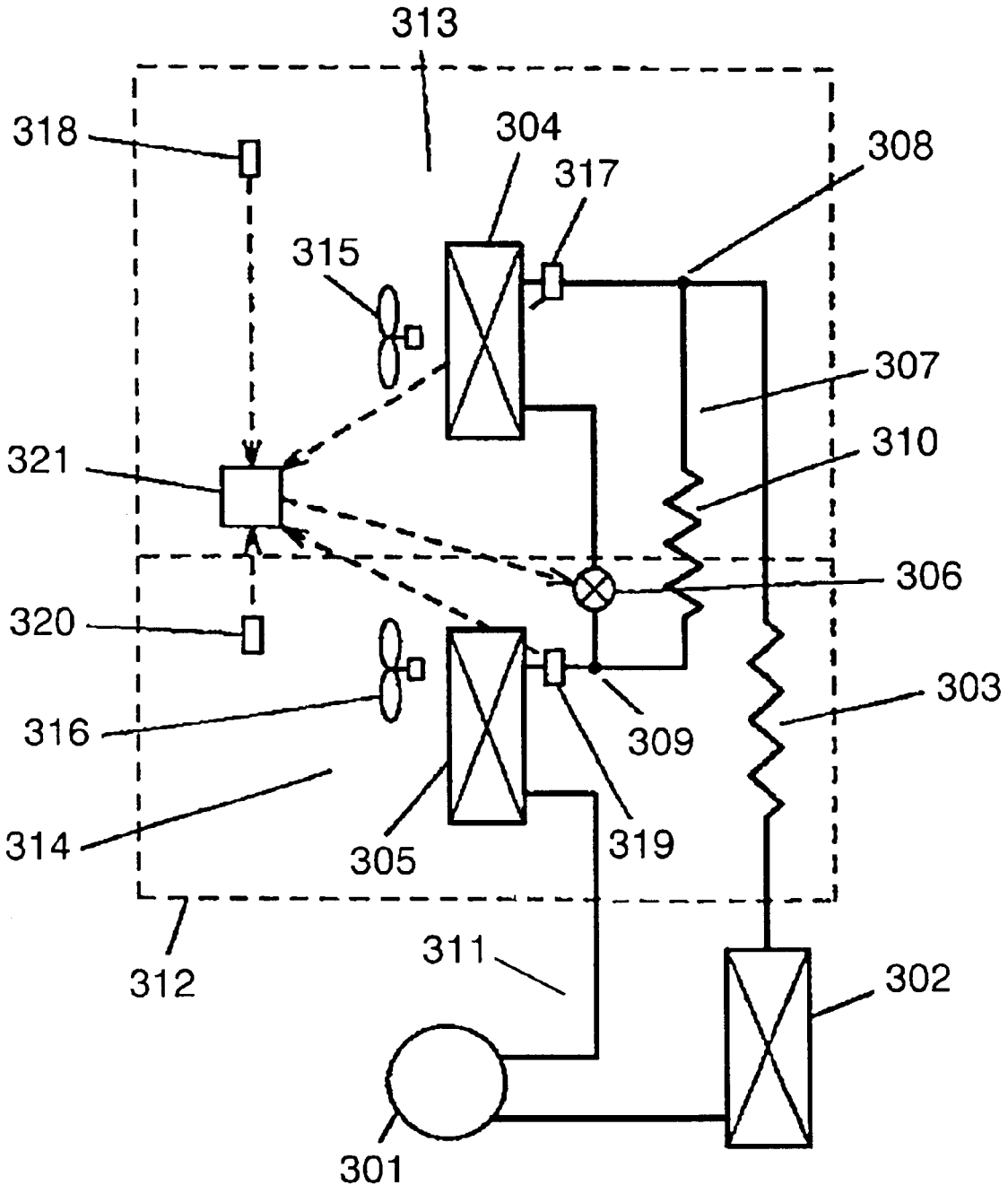
FIG. 5 is a refrigeration system diagram of a refrigerating unit in exemplary embodiment 3 of the present invention.
Figure 6:
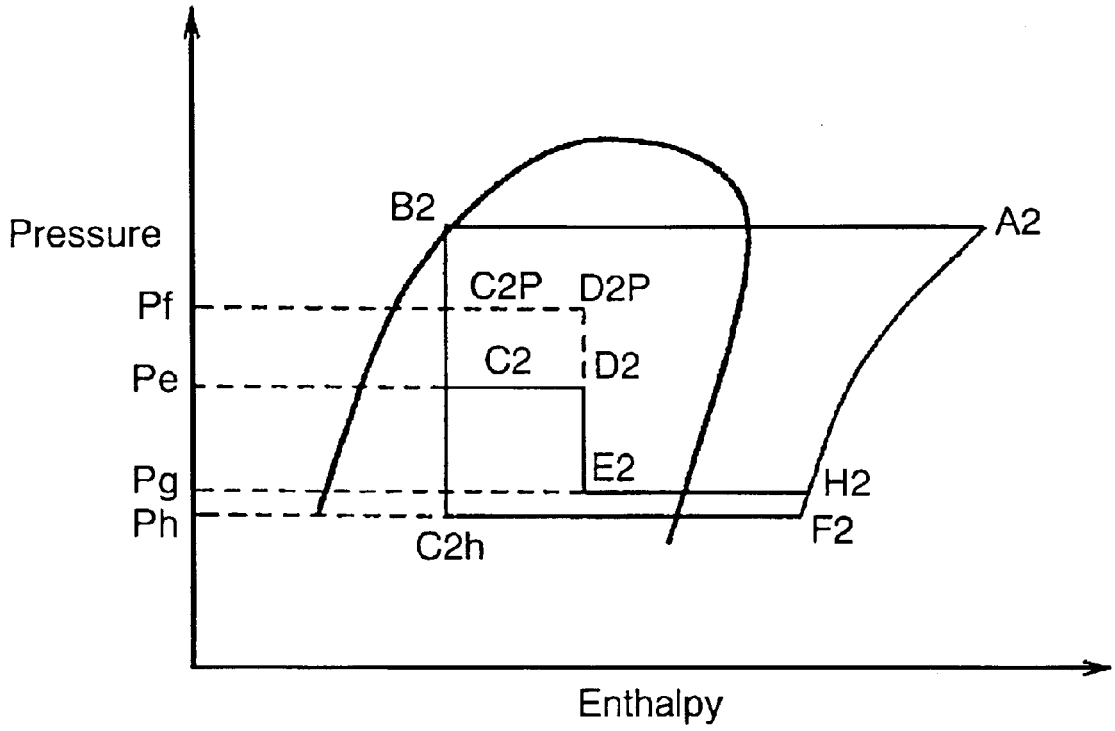
FIG. 6 is a Mollier chart of the refrigerating unit in exemplary embodiment 3 of the present invention.

FIG. 5 is a refrigeration system diagram of a refrigerating unit in exemplary embodiment 3 of the present invention. FIG. 6 is a Mollier chart of the refrigerating unit in exemplary embodiment 3 of the present invention. In FIG. 5, the refrigerating unit comprises compressor 301, condenser 302, first capillary tube 303, first evaporator 304 and second evaporator 305. As refrigerant flow rate adjustable unit 306 is used an electric expansion valve, for example, and the electric expansion valve has a totally closing function. First capillary tube 303 connects between the outlet of condenser 302 and the inlet of first evaporator 304. Refrigerant flow rate adjustable unit 306 is disposed between first evaporator 304 and second evaporator 305. Bypass circuit 307 is connected to branch connection unit 308 disposed at the inlet of first evaporator 304 and also to merging connection unit 309 disposed aat the outlet of refrigerant flow rate adjustable unit 306. Bypass circuit 307 is formed so as to bypass first evaporator 304. Second capillary tube 310 having a relatively small amount of pressure reduction is provided in bypass circuit 307. Suction pipe 311 connects between the outlet of second evaporator 305 and compressor 301. Thus, a refrigeration cycle is established.

Refrigerator's main body 312 has cold storage compartment 313 and freezer compartment 314. First evaporator 304 is installed in cold storage compartment 313 and second evaporator 305 is installed in freezer compartment 314. First air blower 315 is disposed in cold storage compartment 313 and second air blower 316 is disposed in freezer compartment 314.

First evaporator temperature detecting means 317 is located near the inlet of first evaporator 304. Cold storage compartment temperature detecting means 318 detects the temperatures in cold storage compartment 313. Second evaporator temperature detecting means 319 is located near the inlet of second evaporator 305. Freezer compartment temperature detecting means 320 detects the temperatures in freezer compartment 314. Controlling means 321 controls the opening of refrigerant flow rate adjustable unit 306 based on the information from first evaporator temperature detecting means 317, cold storage compartment temperature detecting means 318, second evaporator temperature detecting means 319 and freezer compartment temperature detecting means 320.

Next, a description is given to how the refrigerating unit structured as above performs.

The refrigerant compressed in compressor 301 dissipates heat in condenser 302, is condensed and enters in first capillary tube 303. The condensed refrigerant that is reduced in pressure enters in first evaporator 304 via branch connecting unit 308 and evaporates at the saturation temperature of a pressure corresponding to the extent of throttling (opening) of refrigerant flow rate adjustable unit 306. When the opening of refrigerant flow rate adjustable unit 306 is increased, the evaporation temperature of first evaporator 304 is lowered since the refrigerant pressure becomes closer to the suction pressure (low pressure) of compressor 301. Conversely, when the opening is decreased, the pressure in evaporator 304 is increased and the evaporation temperature is also increased.

In order to control the evaporation temperature of first evaporator 304, the opening of refrigerant flow rate adjustable unit 306 is adjusted by controlling means 321. The information needed for the foregoing controlling is furnished by first evaporator temperature detecting means 317 and cold storage compartment temperature detecting means 318. The refrigerant reduced further in pressure by refrigerant flow rate adjustable unit 306 is merged at merging connection unit 309 with part of the refrigerant flown into bypass circuit 307 at branch connection unit 308 and flows into second evaporator 305. The refrigerant vaporized in second evaporator 305 returns to compressor 301 via suction pipe 311.

At this time, the electric expansion valve serving as refrigerant flow rate adjustable unit 306 has a totally closing function. When cooling in first evaporator 304 is judged as no longer needed (a judgement made through the temperature detected by cold storage compartment temperature detecting means 318, for example) or the frost formed on first evaporator 304 is defrosted under an off cycle state (a periodical operation performed one time or so for every 2 to 3 hours, for example), the totally closing function of the electric expansion valve is carried out. When the electric expansion valve is totally closed, the refrigerant flows into bypass circuit 307 at branch connection unit 308 at the time when compressor 301 is in operation and then flows in second evaporator 305 via merging connection unit 309. The refrigerant evaporates in second evaporator 305 and the evaporated refrigerant returns to compressor 301 via suction pipe 311.

A description is given to the above operation with reference to the Mollier chart of FIG. 6. Compressor 302 has the state of the refrigerant shifted from point A2 to point B2 and first capillary tube 303 has the pressure of the refrigerant reduced from point B2 to point C2. The refrigerant having entered in first evaporator 304 at point C2 evaporates at the saturation temperature against pressure Pe. Point D2 corresponds to the inlet of refrigerant flow rate adjustable unit 306 in position, and the refrigerant is reduced in pressure to point E2 corresponding to the pressure at the outlet thereof, enters in second evaporator 305 and evaporates at the saturation temperature against pressure Pg.

And, the refrigerant is sucked into compressor 301 at point H2 and compressed to point A2 on the Mollier chart.

When the opening of refrigerant flow rate adjustable unit 306 is made smaller, point C2 is shifted to point C2*p* and point D2 to point D2*p*, and the refrigerant is increased in pressure to reach Pf, thereby causing the evaporation temperature of first evaporator 304 to increase. Conversely, when the opening of refrigerant flow rate adjustable unit 306 is made larger, the pressure at point C2 is lowered, thereby causing the evaporation temperature of first evaporator 304 also to be lowered. When the opening of refrigerant flow rate adjustable unit 306 is totally closed, the refrigerant flow into first evaporator 304 is suspended and the refrigerant is further reduced in pressure in second capillary tube 310 and enters in second evaporator 305 at point C2*h*, where the refrigerant evaporates at the saturation temperature against pressure Ph. And, the refrigerant is sucked into compressor 301 at point F2 and compressed to reach point A2.

When cold storage compartment 313 is kept at a cold storage temperatures (1° C. to 5° C., for example) by first evaporator 304 and first air blower 315, the opening of refrigerant flow rate adjustable unit 306 is adjusted to make the evaporation temperature of first evaporator 304 higher. The difference in temperature between the inside of cold storage compartment 313 and the evaporation temperature of first evaporator 304 is made smaller (around 3° C. to 5° C., for example) and kept constant, thereby allowing the excessive refrigeration of cold storage compartment 313 due to cold air sent therein by first air blower 315 to be prevented from occurring during the cooling period of cold storage compartment 313. As a result, the temperature changes in cold storage compartment 313 are reduced.

Furthermore, when the difference in temperature between the inside of cold storage compartment 313 and the evaporation temperature of first evaporator 304 is made smaller, the dehumidifying action in cold storage compartment 313 is suppressed. As a result, the inside of cold storage compartment 313 is kept at a high humidity and the foods stored are prevented from becoming dry.

Therefore, the foods stored in cold storage compartment 313 are allowed to suppress the deterioration in quality caused by temperature changes (heat shock) applied to the foods. On top of that, drying of the foods in storage is prevented, thereby enabling the enhancement of storage quality for the foods stored.

In addition, when the frost formed on first evaporator 304 is periodically defrosted under an off cycle state once every 2 to 3 hours, for example, the electric expansion valve serving as refrigerant flow rate adjustable unit 306 is totally closed and also first blower 315 is operated, thereby allowing the inside of cold storage compartment 313 to be cooled down and also to be kept at a high humidity due to the cooling effect caused by the heat of melting of frost and the humidifying action of defrosted water.

Exemplary Embodiment 4

Figure 7:
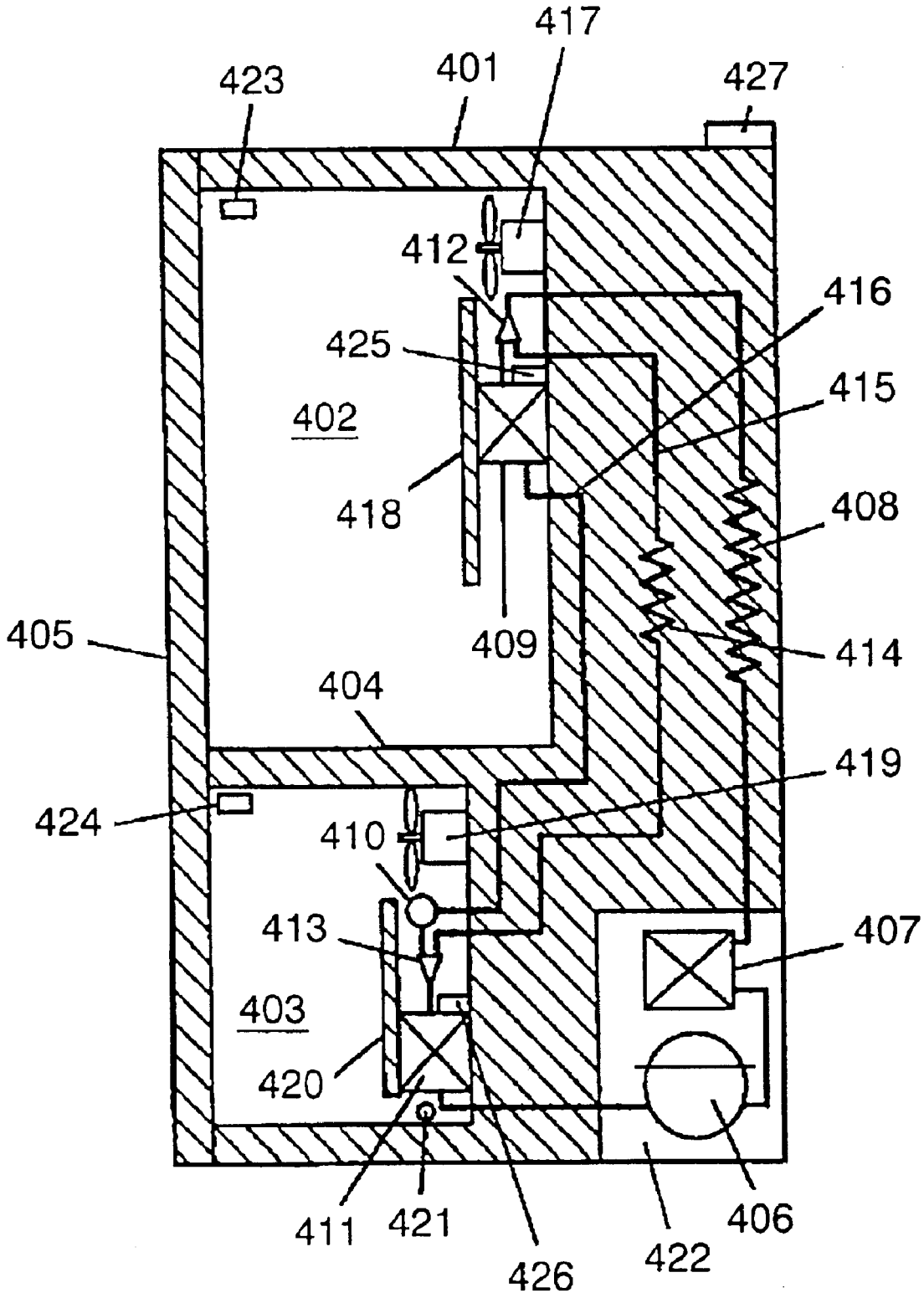
FIG. 7 is a cross-sectional view of a refrigerator, which is equipped with a present invention's refrigerating unit, in exemplary embodiment 4 of the present invention.
Figure 8:
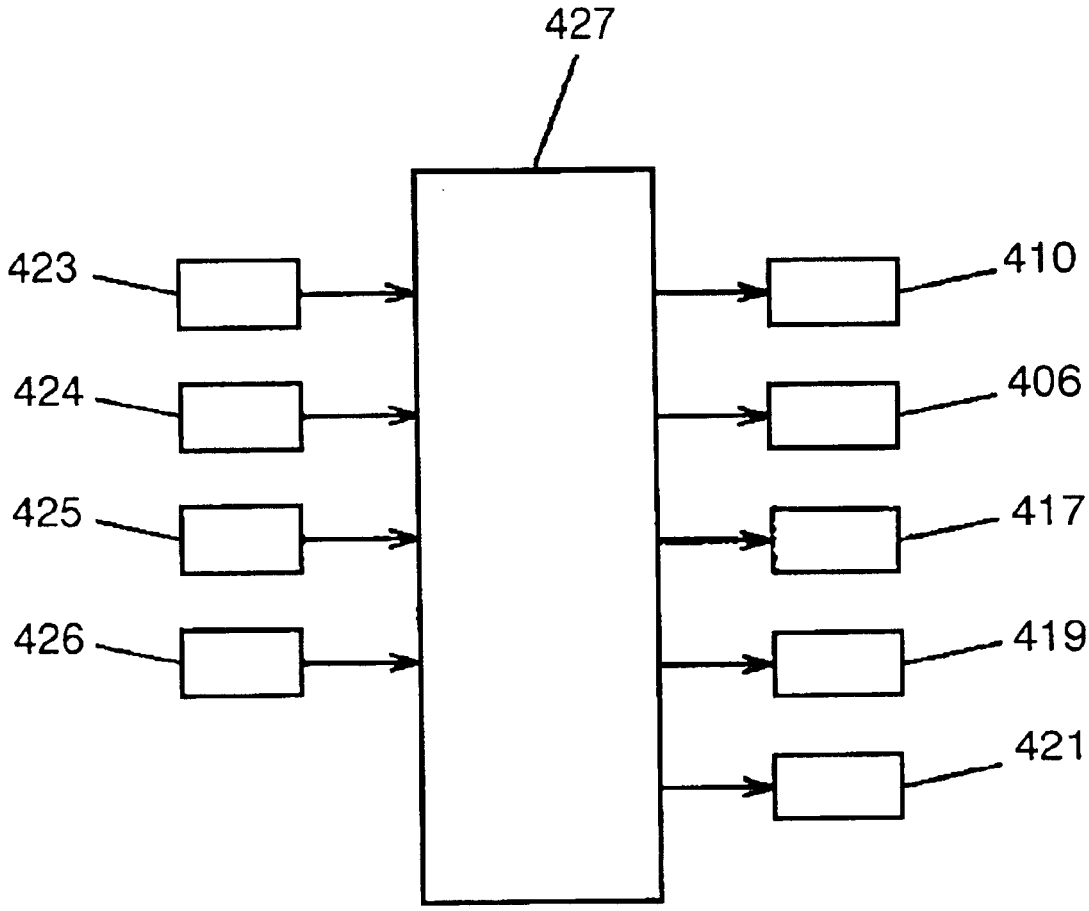
FIG. 8 is a block diagram of the operation control circuit of the refrigerator in exemplary embodiment 4 of the present invention.
Figure 9:
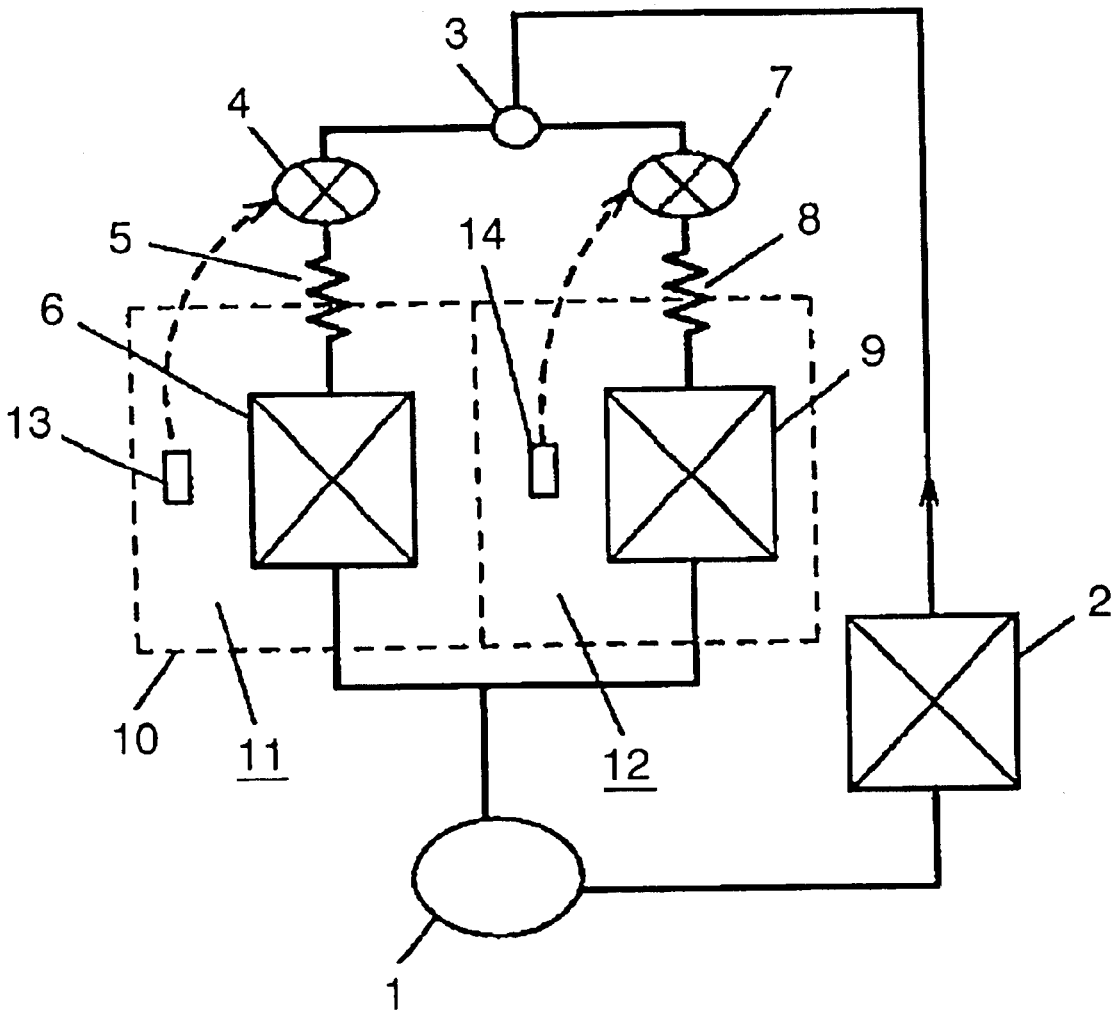
FIG. 9 is a refrigeration system diagram of a prior art refrigerating unit
Figure 10:
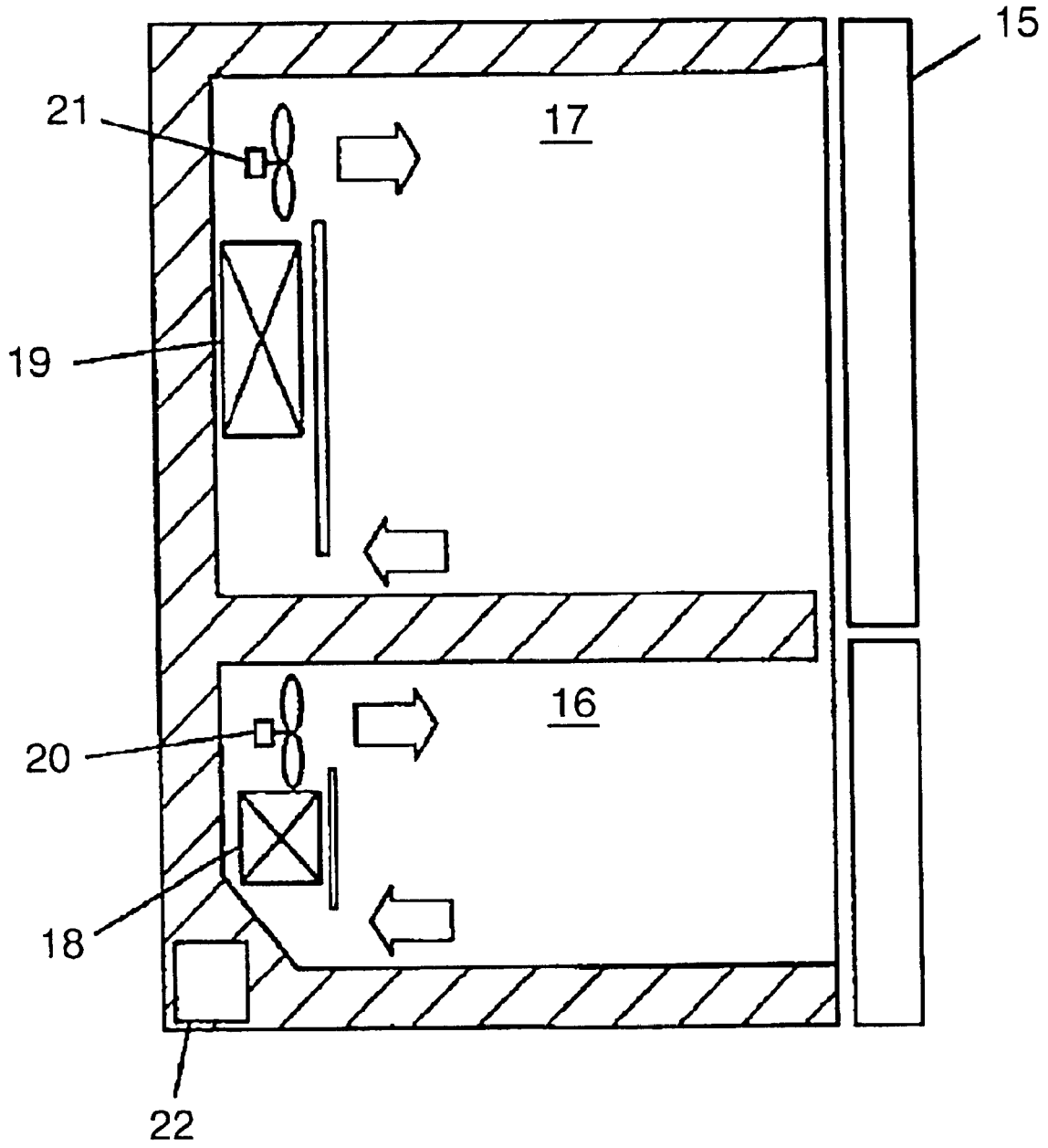
FIG. 10 is a cross-sectional view of a prior art refrigerator.
Figure 11:
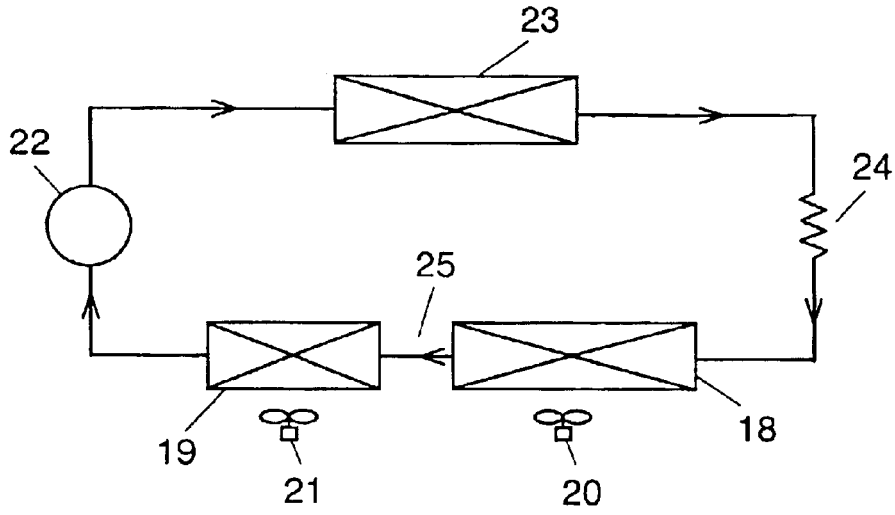
FIG. 11 is a refrigeration system diagram of the prior art refrigerator.
Figure 12:
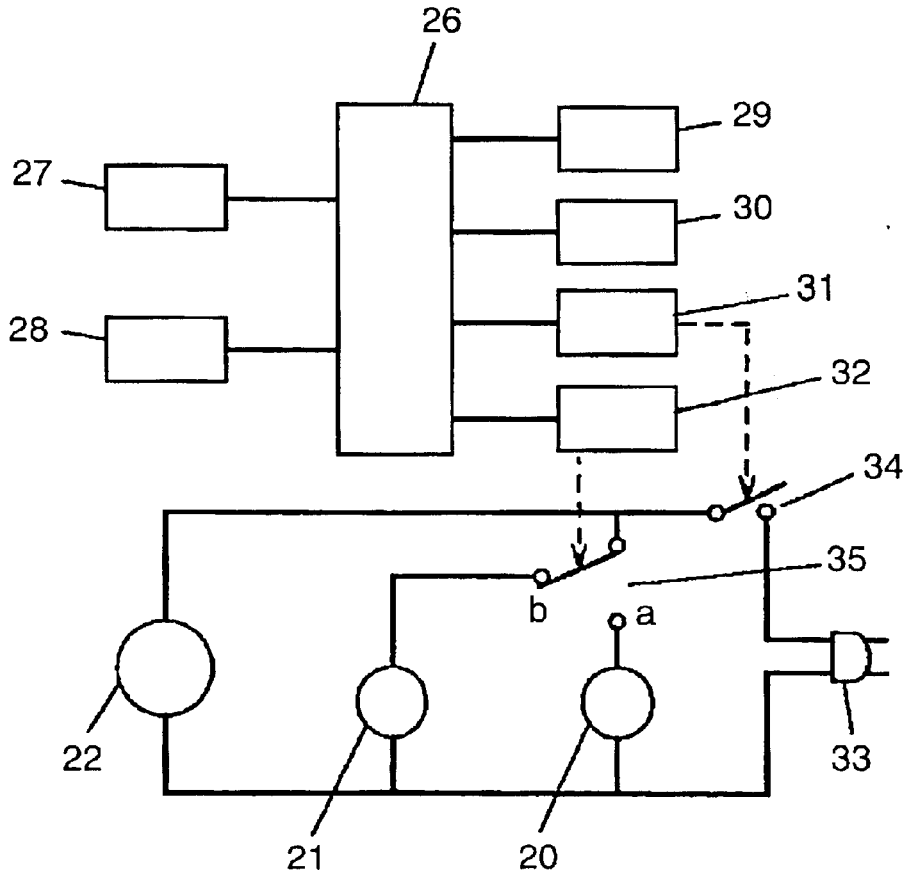
FIG. 12 is a block diagram of the operation control circuit of the prior art refrigerator.

FIG. 7 is a cross-sectional view of a refrigerator in exemplary embodiment 4 of the present invention. FIG. 8 is a block diagram for showing an operation control circuit of the refrigerator of FIG. 7. In FIG. 7 and FIG. 8, refrigerator's main body 401 comprises at least one of cold storage compartment 402 located in the upper part thereof, at least one of freezer compartment 403 located in the lower part thereof, thermal insulation wall 404 and thermal insulation door 405.

A refrigeration cycle includes compressor 406, condenser 407, first capillary tube 408, cold storage compartment evaporator 409, electric expansion valve 410 acting as a refrigerant flow rate adjustable unit and freezer compartment evaporator 411, all of which are connected in series successively. In addition, branch connection unit 412 is disposed between first capillary tube 408 and cold storage compartment evaporator 409 and merging connection unit 413 is disposed between electric expansion valve 410 and freezer compartment evaporator 411. Second capillary tube 414 is disposed in bypass circuit 415. Electric expansion valve 410 has a totally closing function.

Connection piping 416 connects between cold storage compartment evaporator 409 and electric expansion valve 410 and also connects between electric expansion valve 410 and freezer compartment 411. The diameter of connection piping 416 is made large enough not to create a large resistance against the passage of refrigerant. As a matter of fact, connection piping 416 has almost the same diameter as the pipe diameter of an evaporator.

Cold storage compartment evaporator 409 is located, for example, on the furthermost surface in cold storage compartment 402. Near cold storage compartment evaporator 409 are located cold storage compartment air blower 417 and cold storage duct 418 for moving the air inside of cold storage compartment 402 to pass through cold storage compartment evaporator 409 and to circulate around there.

Freezer compartment evaporator 411 is located, for example, on the furthermost surface in freezer compartment 403. Near freezer compartment evaporator 411 are located freezer compartment air blower 419 and freezer duct 420 for moving the air inside of freezer compartment 403 to pass through freezer compartment evaporator 411 and to circulate around there.

Electric expansion valve 410 is disposed inside freezer compartment 403 and adjusts the flow of refrigerant from cold storage compartment evaporator 409 to freezer compartment evaporator 411 by controlling the valve opening.

Merging connection unit 413 is also disposed inside freezer compartment 403 near electric expansion valve 410, for example. The other connection unit of branch connection unit 412 is located inside cold storage compartment 403 near cold storage compartment evaporator 409, for example.

Near freezer compartment evaporator 411 is disposed defrosting heater 421.

Compressor 406 and condenser 407 are installed in machine compartment 422 located in the furthermost corner of the lower part of refrigerator's main body 401.

Cold storage compartment temperature detecting means 423 is disposed in cold storage compartment 402 and freezer compartment temperature detecting means 424 is disposed in freezer compartment 403. Cold storage compartment evaporator temperature detecting means 425 is located near cold storage compartment evaporator 409 and freezer compartment evaporator temperature detecting means 426 is located near freezer compartment evaporator 411. Based on the information from respective temperature detecting means, controlling means 427 controls compressor 406, electric expansion valve 410, cold storage compartment air blower 417, freezer compartment air blower 419 and defrosting heater 421.

When defrosting heater 421 is turned on at regular intervals for the purpose of defrosting freezer compartment evaporator 411, electric expansion valve 410 is controlled by controlling means 427 to be put at full opening.

Next, a description is given to how the refrigerator structured as in above operates.

When freezer compartment 403 rises in temperature excessively, freezer compartment temperature detecting means 424 detects the fact that the temperature of freezer compartment 403 has exceeded a predetermined temperature. Controlling means 427 receives a signal on the temperature of freezer compartment 403 and puts compressor 406, freezer compartment air blower 419 and electric expansion valve 410 into operation. The high temperature and high pressure refrigerant discharged upon putting compressor 406 into operation is compressed and condensed in condenser 407, reduced in pressure in first capillary tube 408 and reaches branch connection unit 412.

When cold storage compartment temperature detecting means 423 detects the fact that the temperature of cold storage compartment 402 exceeds a predetermined temperature, electric expansion valve 410 takes the action of opening the valve, thereby allowing the refrigerant to reach cold storage compartment evaporator 409. Cold storage compartment air blower 417 is put into operation and the air inside cold storage compartment 402 is sucked in cold storage compartment evaporator 409 where a heat exchange takes place actively, thereby allowing the sucked air to be discharged with the temperature thereof further lowered.

At this time, the opening of electric expansion valve 410 is adjusted such that the difference between the temperature set up for cold storage compartment 402 and the temperature detected by cold storage compartment evaporator temperature detecting means 425 is kept constant (5° C., for example). As the temperature of the air inside cold storage compartment 402 declines and when the temperature detected by cold storage compartment temperature detecting means 423 is found to be lower than a predetermined temperature, controlling means 427 takes an action of totally closing electric expansion valve 410. When the temperature detected by cold storage compartment temperature detecting means 423 exceeds a predetermined temperature, cold storage compartment air blower 417 is similarly put into operation. Conversely, when the detected temperature is found to be lower than the predetermined temperature, cold storage compartment air blower 417 ceases operation.

When electric expansion valve 410 is closed, the refrigerant flows in bypass circuit 415 formed of second capillary tube 414 via branch connection unit 412 and then reaches freezer compartment evaporator 411 after further reduced in pressure. By the operation of freezer compartment air blower 419, the air inside freezer compartment 403 is sucked via freezer duct 420 in freezer compartment evaporator 411 where a heat exchange takes place actively, thereby causing the refrigerant to be vaporized. The vaporized refrigerant is again sucked in compressor 406. The air having undergone a heat exchange is discharged with the temperature thereof further lowered. As the temperature of the air inside freezer compartment 403 is lowered and when the temperature detected by freezer compartment temperature detecting means 424 is found to be lower than a predetermined temperature, controlling means 427 suspends the operation of compressor 406 and freezer compartment air blower 419, and electric expansion valve 410 is put into operation and closed.

When electric expansion valve 410 is closed after the temperature detected by cold storage compartment temperature detecting means 423 of cold storage compartment 402 is found to be exceeding a predetermined temperature, the refrigerant reaches cold storage compartment evaporator 411 via branch connection unit 412 and then enters in freezer compartment evaporator 411 via electric expansion valve 410. Also, part of the refrigerant enters at branch connection unit 412 into second capillary tube 414, merges with the aforementioned refrigerant flow at merging connection unit 413 and enters in freezer compartment evaporator 411. The refrigerant evaporated in cold storage compartment evaporator 409 and freezer compartment evaporator 411 is again sucked in compressor 406.

At this time, when the difference between the temperature of cold storage compartment 402 and the predetermined temperature is large, the opening of electric expansion valve 410 is increased, thereby enhancing the cooling ability of cold storage compartment evaporator 409. When the difference between the temperature of cold storage compartment 402 and the predetermined temperature is small, the opening of electric expansion valve 410 is decreased, thereby reducing the flow rate of refrigerant in cold storage compartment evaporator 409 and lowering the cooling ability of cold storage compartment evaporator 409. And, by putting cold storage compartment air blower 417 into operation, the air inside cold storage compartment 402 is sucked in via cold storage duct 418 and a heat exchange takes place actively, thereby causing part of the refrigerant to be evaporated in cold storage compartment evaporator 409. The air after the heat exchange is discharged and, when the temperature of the discharged air is found lower than a predetermined temperature by the temperature detecting means, controlling means 427 brings the operation of cold storage compartment air blower 417 to suspension, and electric expansion valve 410 is closed by the totally closing action thereof.

Similarly, freezer compartment 403 is cooled down by putting freezer compartment air blower 419 into operation and, when the temperature of freezer compartment 403 is found lower than a predetermined temperature by freezer compartment temperature detecting means 424, controlling means 427 brings the operation of compressor 406 and freezer compartment air blower 419 to suspension, and electric expansion valve 410 is closed by the totally closing action thereof.

By repeating the operation as described in above, the refrigerator undergoes cooling, and cold storage compartment 402 and freezer compartment 403 are cooled down to reach a predetermined temperature, respectively. When the evaporation temperature of cold storage compartment evaporator 409 is maintained at −5° C., for example, by controlling the opening of electric expansion valve 410, the difference between the temperature of cold storage compartment 402 and the evaporation temperature is kept relatively small, thereby allowing the dehumidifying action to be suppressed and allowing the humidity inside cold storage compartment 402 to be kept high. As a result, the storage quality of foods is maintained at a high level.

As refrigerant flow rate adjustable unit 410 is used an electric expansion valve which has the function of totally closing, thereby allowing the flow rate control to be performed less costly and yet with a high degree of accuracy. In addition, an accurate change-over action between refrigerant flow channels is made possible. Therefore, when cooling of cold storage compartment evaporator 409 is no longer required because of the low ambient temperature or a small number of the objects to be cooled, the refrigerant is directed to take a bypassing route in bypass circuit 415, thereby allowing the temperature changes of the object to be cooled to be suppressed and allowing a high efficiency cooling action to be performed at an evaporation temperature that is appropriate to the object to be cooled. As a result, achievement of energy savings is made possible while excellent cooling performance being maintained.

Through the action of controlling means 427, cold storage compartment air blower 417 is put into operation while electric expansion valve 410 repeating the totally closing action (approximately once every 2 to 3 hours, for example), thereby cooling down cold storage compartment 402 while the frost formed on cold storage compartment evaporator 409 being removed by melting As a result, the humidifying action caused by the water produced by defrosting brings the humidity inside cold storage compartment 402 to a high level. Therefore, the periodical defrosting action usually performed by means of a heater and the like becomes no longer necessary.

Since electric expansion valve 410 is disposed inside freezer compartment 403, the humidity in freezer compartment 403 is low in comparison with cold storage compartment 402. Therefore, the forming of frost on electric expansion valve 410 is suppressed, thereby allowing the frost formed on electric expansion valve 410 to be removed with reliability at the time of defrosting. As a result, the operation of electric expansion valve 410 is carried out properly and the respective temperatures of cold storage compartment 402 and freezer compartment 403 are stabilized and kept at a predetermined temperature, respectively.

Since electric expansion valve 410 is disposed inside freezer compartment 403, the water content in cold storage compartment 402 is prevented from getting removed in the form of frost, thereby allowing the interior of cold storage compartment 402 to be kept high in humidity and also allowing the foods in storage to be prevented from becoming dry.

For the purpose of defrosting freezer compartment evaporator 411, electric expansion valve 410 is totally opened when defrost heater 421 is turned on periodically, thereby allowing the heat from defrost heater 421 to be transferred to cold storage compartment evaporator 409 via refrigerant. As a result, the defrosting of cold storage compartment 409 is also carried out without fail.

Accordingly, the refrigerator of the present exemplary embodiment enables the quality degradation of foods stored in cold storage compartment 402 due to a temperature variation (heat shock) to be reduced and also enables the foods in storage to be prevented from becoming dry. As a result, the storage quality of foods is enhanced.

Furthermore, the extent of cooling for cold storage compartment evaporator 409 installed in parallel to bypass circuit 415 is properly adjusted and defrosting under an off cycle state is made possible.

Also, frosting on electric expansion valve 410 is prevented, thereby enhancing the reliability of the refrigerator.

Although the plurality of cooling compartments include cold storage compartment 402 and freezer compartment 403 and an evaporator of a relatively high evaporation temperature zone is installed in cold storage compartment 402 according to the present exemplary embodiment, the architecture of a refrigerator is not limited to above. Instead, such an architecture as the plurality of cooling compartments being inclusive of a vegetable compartment and a bottled drink compartment, and an evaporator being disposed in the respective compartments or disposed commonly in these compartments can be employed with the same advantages as the foregoing made attainable.

Industrial Applicability

According to the structure as described in above, a capillary tube and the throttling action of a refrigerant flow rate adjustable unit together realize a differentiation in evaporation temperatures in a stable manner for a plurality of evaporators even with a refrigeration cycle characterized by a relatively small amount of refrigerant in circulation. As a result, the efficiency of refrigeration cycle is enhanced at a properly established evaporation temperature for each respective evaporator, thereby enabling the realization of energy savings.

The cooling function exhibiting a high efficiency at a desired evaporation temperature for each respective evaporator is allowed to come into play. When cooling of an evaporator of interest is not needed, the evaporator is bypassed, thereby enabling the cooling to be focused only on the evaporators needed to be cooled down, thereby avoiding wasteful cooling and realizing savings in electric power.

Efficient cooling at each respective evaporation temperature is made possible. When a first evaporator is not needed to be cooled down, the first evaporator is bypassed and the refrigerant is circulated in a second evaporator only, thus allowing the loss in cooling to be prevented from occurring.

A high-precision and less costly refrigerant flow rate control and a reliable refrigerant flow channel switching action are made possible, thereby realizing the enhancement of refrigeration cycle efficiency.

The electric power consumed in defrosting by a defrost heater and the like can be cut back.

The evaporation temperatures of a plurality of evaporators are adjustable/controllable, resulting in a reduction of the difference between the storage temperature of foods in storage and the cooled air temperature at the proper evaporation temperature of each respective evaporator. Therefore, temperature changes and also drying of foods can be prevented from occurring.

Existence of a difference in evaporation temperature between a first evaporator and a second evaporator allows the intra-compartment temperature difference between a cold storage compartment and a freezer compartment to be realized efficiently. A reduction in temperature difference between the cold storage compartment temperature and the evaporation temperature of the first evaporator enables the temperature variation and dehumidifying action inside the cold storage compartment to be suppressed.

By controlling the amount of throttling of a refrigerant flow rate adjustable unit to reduce the difference between the evaporation temperature of each respective evaporator and the intra-compartment temperature of each respective cooling compartment to 5° C. or less, the temperature variation and dryness inside the cooling compartment can be further suppressed. Also, the efficiency of refrigeration cycle can be further enhanced.

By controlling the evaporation temperature of the first evaporator within a range of −5° C. to 5° C., the difference between the cold storage compartment temperature and the evaporation temperature of the first evaporator is further reduced, thereby allowing the temperature variation and dehumidifying action of the cold storage compartment to be further suppressed.

By installing a refrigerant flow rate adjustable unit in a freezer temperature compartment, the forming of frost on an electric expansion valve is reduced, thereby allowing the defrosting of the electric expansion valve to be facilitated.

When the freezer temperature compartment is cooled down quickly, the amount of throttling of the refrigerant flow rate adjustable unit is reduced and the evaporation temperature of the second evaporator is lowered, thereby lowering the temperature of cold air supplied to the freezer compartment and accelerating the refrigeration speed of foods and the like. As a result, the effect of rapid refrigeration is increased and the refrigeration storage quality of foods is enhanced.

What is claimed is:

1. A refrigerating unit comprising:

(a) compressor;

(b) condenser;

(c) a plurality of evaporators connected in series;

(d) a capillary tube disposed between said condenser and each of said plurality of evaporators;

(e) a coolant flow rate adjustable unit disposed between respective evaporators of said plurality of evaporators;

(f) a bypass circuit bypassing it least one evaporator of said plurality of evaporators; and (g) a coolant, wherein said bypass circuit is disposed in parallel with said at least one evaporator and said coolant flow rate adjustable unit, said compressor, condenser, evaporator, capillary tube, coolant flow rate adjustable unit, bypass circuit and coolant constitute a refrigeration cycle, said coolant circulates in said refrigeration cycle, said coolant flow rate adjustable unit controls variably respective evaporation temperatures of said plurality of evaporators, and when cooling of said at least one evaporator disposed in parallel with said bypass circuit is not needed, said coolant flow rate adjustable unit is totally closed, thereby allowing said coolant to be channeled to said bypass circuit only.

2. The refrigerating according to claim 1, wherein said plurality of evaporators include a first evaporator and a second evaporator, said coolant flow rate adjustable unit is disposed between said first evaporator and said second evaporator, said capillary tube has a first capillary tube and a second capillary tube, said first capillary tube is disposed between said condenser and said first evaporator, said bypass circuit has a branch connection unit, said second capillary tube and a merging connection unit, and said coolant flowing from said first capillary tube flows bybreaking into two flows at said branch connection wilt, one flowing in said first evaporator and another flowing in said bypass circuit, and said two flows merge at said merging connection unit to get to said second evaporator.

3. The refrigerating unit according to claim 1, wherein said coolant flow rate adjustable unit is totally closed when said at least one evaporator disposed in parallel with said bypass circuit is defrosted under an off cycle state.

4. A refrigerating unit comprising:

(a) a compressor;

(b) a condenser;

(c) a first evaporator and a second evaporator connected in series;

(d) a coolant flow rate adjustable unit with a function of totally closing disposed between said first evaporator and said second evaporator;

(e) a capillary tube disposed between said condenser and said first evaporator; and (f) a bypass circuit bypassing said first evaporator and said coolant flow rate adjustable unit, wherein said compressor, condenser, first evaporator, second evaporator, coolant flow rate adjustable unit, capillary tube, bypass circuit and coolant constitute a refrigeration cycle, said coolant flow raw adjustable unit controls a flow rate of said coolant such that a first evaporation temperature of said first evaporator is made higher than a second evaporation temperature or said second evaporator, and, when cooling of said at least one evaporator disposed in parallel with said bypass circuit is not needed, said coolant flow rate adjustable unit is totally closed, thereby allowing said coolant to be channeled to said bypass circuit only.

5. The refrigerating unit according to claim 4, wherein said coolant flow rate adjustable unit is totally closed when said at least one evaporator disposed in parallel with said bypass circuit is defrosted under an off cycle state.

6. A refrigerator comprising a plurality of cooling compartments and said refrigerating unit according to claim 1, wherein respective cooling compartments of said plurality of cooling compartments are set to temperatures that are different from one another, said each respective evaporator is installed in each respective cooling compartment of said plurality of cooling compartments, said refrigerant flow rate adjustable unit controls a flow rate of said refrigerant such that an evaporation temperature of said each respective evaporator located at an upstream side of said refrigeration cycle is made higher than an evaporation temperature of said each respective evaporator located at a downstream side thereof, and said each respective evaporator located at an upstream side of said refrigeration cycle is installed in respective cooling compartments, each being set to a higher temperature in succession.

7. A refrigerator comprising a plurality of cooling compartments and said refrigerating unit according to claim 4, wherein said plurality of cooling compartments include a cold storage temperature compartment and a freezer temperature compartment, said first evaporator is installed in said cold storage temperature compartment; and said second evaporator is installed in said freezer temperature compartment.

8. A refrigerator comprising a plurality of cooling compartments and said refrigerating unit according to claim 5, wherein said plurality of cooling compartments include a cold storage temperature compartment and a freezer temperature compartment, said first evaporator is installed in said cold storage temperature compartment, and said second evaporator is installed in said freezer temperature compartment.

9. The refrigerator according to claim 6, wherein said refrigerant flow rate adjustable unit controls a flow rate of said refrigerant such that a difference in temperature between an interior of said each respective cooling compartment and said each respective evaporator installed in said each respective cooling compartment is 5° C. or less.

10. The refrigerator according to claim 7, wherein an evaporation temperature of said first evaporator is controlled such that an evaporation temperature of said first evaporator ranges from −5° C. to 5° C.

11. The refrigerator according to claim 7, wherein said refrigerant flow rate adjustable unit is installed in said freezer temperature compartment.

12. The refrigerator according to claim 7, wherein, when said freezer temperature compartment is rapidly cooled down, said second evaporation temperature of said second evaporator is made lower than said first evaporation temperature of said first evaporator by reducing an extent of throttling of said refrigerant flow rate adjustable unit.

13. The refrigerator according to claim 7, wherein said refrigerant flow rate adjustable unit controls a flow rate of said refrigerant such that a difference in temperature between an interior of said each respective cooling compartment and said each respective evaporator installed in said each respective cooling compartment 5° C. or less.

14. The refrigerator according to claim 7, wherein an evaporation temperature of said first evaporator is controlled such that an evaporation temperature of said first evaporator ranges from −5° C. to 5° C.

15. The refrigerator according to claim 8, wherein said refrigerant flow rate adjustable unit is installed in said freezer temperature compartment.

16. The refrigerator according to claim 8, wherein, when said freezer temperature compartment is rapidly cooled down, said second evaporation temperature of said second evaporator is made lower than said first evaporation temperature of said first evaporator by reducing an extent of throttling of said refrigerant flow rate adjustable unit.

17. The refrigerating unit according to claim 2, wherein said coolant flow rate adjustable unit is totally closed when said at least one evaporator disposed in parallel with said bypass circuit is defrosted under an off cycle state.

* * * * *